US006834708B1

(12) United States Patent
Hoffmann et al.

(10) Patent No.: US 6,834,708 B1
(45) Date of Patent: Dec. 28, 2004

(54) ALUMINIUM ALLOYS STRIPS WITH HIGH SURFACE HOMOGENEITY AND METHOD FOR MAKING SAME

(75) Inventors: Jean-Luc Hoffmann, Matzenheim (FR); Pierre-Yves Menet, Colmar (FR); Klaus Maiwald, Moirans (FR); Regine Debreux, Le Touvet (FR); Martin-Peter Schmidt, La Murette (FR); Yves Scelles, Vodable (FR)

(73) Assignee: Pechiney Rhenalu, Paris (FR)

( * ) Notice: Subject to any disclaimer, the term of this patent is extended or adjusted under 35 U.S.C. 154(b) by 0 days.

(21) Appl. No.: 09/582,625

(22) PCT Filed: Feb. 12, 1999

(86) PCT No.: PCT/FR99/00319

§ 371 (c)(1),
(2), (4) Date: Aug. 8, 2000

(87) PCT Pub. No.: WO99/41031

PCT Pub. Date: Aug. 19, 1999

(30) Foreign Application Priority Data

Feb. 13, 1998 (FR) ..... 98 01987

(51) Int. Cl.[7] ..... B22D 11/00; C22F 1/04

(52) U.S. Cl. ..... 164/477; 148/549; 428/694 TR; 428/694 BR; 205/328

(58) Field of Search ..... 164/476, 477; 148/549, 547, 437; 428/612, 687, 694 TR, 694 BR, 472.2; 205/704, 324, 328

(56) References Cited

U.S. PATENT DOCUMENTS 4,054,173 A 10/1977 Hickam
4,153,101 A 5/1979 Chateau et al.
4,582,541 A 4/1986 Dean et al.
4,681,152 A 7/1987 Flowers et al.
5,350,010 A 9/1994 Sawada et al.
5,853,806 A * 12/1998 Higuchi et al. ..... 427/310
5,998,044 A * 12/1999 Limbach et al. ..... 428/687

FOREIGN PATENT DOCUMENTS

| | | |
|---|---|---|
| DE | 2443068 | 3/1976 |
| EP | 0761343 | 3/1997 |
| EP | 0821074 | 1/1998 |
| GB | 897412 | 5/1962 |
| GB | 2198976 | 6/1988 |

OTHER PUBLICATIONS

DE XP002083848 "Handbook on Continuous Casting", E. Herrmann et al, Jul. 1984, p. 11.

* cited by examiner

*Primary Examiner*—Kiley Stoner
*Assistant Examiner*—Len Tran
(74) *Attorney, Agent, or Firm*—Dennison, Schultz, Dougherty & MacDonald

(57) ABSTRACT

An aluminum alloy strip of high surface homogeneity, intended for applications requiring good visual quality or specific optical properties, such as reflectors and anodized plates for construction and decoration. The strip may be characterized by an upper side having, after a 1 $\mu$m thick sulphur anodic treatment, an optical roughness value $S_N$ measured on three 5 cm longitudinal sections and three 5 cm transverse sections, such that there is mean variation on each section, defined by the ratio:

$$(\text{Maximum } S_N - \text{minimum } S_N)/\text{Mean } S_N$$

which is less than 20%, and a difference $\Delta S_N = S_N$ max$-S_N$ min which is less than 20.

31 Claims, 2 Drawing Sheets

ALUMINIUM ALLOYS STRIPS WITH HIGH SURFACE HOMOGENEITY AND METHOD FOR MAKING SAME

FIELD OF THE INVENTION

The invention relates to aluminium alloy strips with high surface homogeneity, intended for applications requiring a good visual quality or specific optical properties, such as reflectors or anodised plates for construction and decoration. It also relates to a method for making said strips by twin-roll casting.

STATE OF THE DESCRIPTION RELATED ART

Twin-roll casting has been widely used for several decades to manufacture foils or standard sheets made of aluminium alloys. As described in the basic patent FR 1198006 filed in 1958 by Pechiney, it consists of introducing the liquid metal, stored in a supply tank, in the gap between two cooled horizontal rolls rotating in opposite directions, using an injector. The metal is solidified in the form of a continuous strip, while being reduced in thickness due to the roll pressure. These continuous casting machines are very often used to produce strips between 5 and 12 mm in thickness. In their most recent versions, such as Pechiney Rhenalu's JUMBO 3 CM® casting, they also make it possible to cast thinner strips less than 5 mm thick as described, for example, in the patent FR 2737430.

The strips from these machines are very rarely used as cast. They generally undergo a first cold rolling sequence and, for some applications, a second finishing cold rolling sequence, possibly with special rolls.

These usual twin-roll casting machines make it possible to obtain strips of a homogeneous appearance, but for very demanding applications in terms of surface condition, associated with a surface treatment of the strip liable to reveal existing surface defects or create said defects from metallurgical heterogeneities, e.g. an anodic treatment, chemical or electrolytic brightening, pickling, chemical brightening, cataphoresis or enamelling, the surface quality of strips obtained from twin-roll casting is currently not sufficient. The upper side of the cast strip generally comprises ripples, presented in the form of lines perpendicular to the direction of casting (transverse-longitudinal direction), which appear to be caused by the oscillation of the meniscus of liquid metal during casting. After anodic treatment, these ripples become visible in the form of parallel streaks; this is a visual defect which is conveyed by a difference in the grey levels with a pitch of the order of one to several (e.g. ten) millimeters.

Another surface defect frequently observed consists of parallel mechanical scratches along the strip; this is a roughness defect. The lower side is of usual mill finish quality.

In addition to these two types of surface defect, accidental scratching which is not specific to the twin-roll casting technique occasionally occurs.

The need to improve the surface appearance of strips obtained by continuous casting has been expressed for some time and a number of solutions have been proposed.

For example, American patent U.S. Pat. No. 4,461,152 describes a liquid metal treatment process starting with the injection in the liquid metal of a gas containing chlorine, followed by the passage of the liquid metal through a series of coalescence chambers, and completed with a filtration, thus enabling the reduction of the inclusion rate in the liquid metal, resulting in the improvement of the surface appearance of 5086 and 5182 alloy strips for computer disks. However, manufacturers now tend to try to minimise the use of chlorinated gases.

German patent application DE 2443068 of 1974 describes a continuous casting machine between steel belts which aims to improve the surface appearance of aluminium or aluminium alloy strips so as to be able to produce strips for a decorative anodic treatment. The technical solution proposed in said patent application cannot be applied to twin-roll casting, for three reasons:

The surface quality of a strip obtained by continuous casting between belts is intrinsically poorer than with twin-roll casting, which is probably due to belt vibrations. The metal solidification conditions are totally different, since, for continuous casting between belts, the centre of the strip is solidified downstream from the level of the axes of the rolls near the injector, while, for twin-roll casting, it is solidified upstream from this axis. Finally, continuous casting between belts cannot be used to obtain thin strips less than 5 mm thick; consequently, the gap between the rolls is smaller in a twin-roll casting machine.

British patent application GB 2198976 describes an asymmetrical injector device making it possible to increase the casting rate and, therefore, the industrial output of a twin-roll casting machine; the document does not describe an improvement in the surface of the products obtained, which was not the subject of the invention described.

American patent U.S. Pat. No. 5,350,010 aims to optimise the surface quality of strips intended to produce offset printing plates by the precise monitoring of the grain size of the final product, which implies that a certain metal composition is complied with and that certain process parameters, occurring downstream from the continuous casting, such as the cold rolling pass reduction rate, are monitored. Given that the surface defects present on the as cast strip do not generally disappear during the cold rolling operations that follow, this approach, in the applicant's opinion, does not seem to deal with the cause of the defects but only tries to minimise their consequences on the finished product.

Following a similar technical approach, patent application EP 0821074 also describes a conversion process of a strip obtained by twin-roll casting, enabling the manufacture of offset plates.

The applicant has noted that none of these approaches make it possible to obtain surfaces meeting high optical and visual homogeneity requirements directly by twin-roll casting, possibly followed by several cold rolling passes.

SUMMARY OF THE INVENTION

The purpose of the present invention is to obtain, by twin-roll casting, aluminium alloy strips with, on at least one side, high surface homogeneity and that can be used for applications that were previously not open to them. It should be noted that the majority of these applications only absolutely require a very homogeneous surface condition for one of the two sides. Therefore, it is not a problem that the present invention only produces a spectacular improvement in the surface condition for one of the two sides.

The strips according to the invention, cast continuously between two rolls, less than 12 mm thick, preferably less than 5 mm, comprise an upper side, the surface condition of which may be characterised at three different stages of manufacture, corresponding to three types of more or less elaborate industrial products, on specimens subjected to a particular preparation, representing a typical industrial surface treatment revealing surface defects:

a) The as cast strips show on the surface (excluding accidental mechanical scratching visible to the naked eye) of their upper side, after creating a 1 $\mu$m thick anodic oxide layer by sulphur anodic treatment, an optical roughness value $S_N$, measured on three 5 cm longitudinal sections and three 5 cm transverse sections, such that its mean variation on each section, defined by the ratio:

$$(\text{Maximum } S_N - \text{minimum } S_N)/\text{Mean } S_N$$

is less than 20%, and the difference: $\Delta S_N = S_N \max - S_N \min$ is less than 20.

b) The strips after cold rolling to a thickness between 4 and 0.1 mm, preferably between 2 and 0.1 mm, show on the surface of their upper side an optical roughness value $S_N$, measured under the same conditions, on a specimen having undergone an alkaline pickling treatment on 10 $\mu$m followed by a sulphur anodic treatment resulting in the creation of a 1 $\mu$m thick anodic oxide layer, such that its mean variation on each section is less than 20% and $\Delta S_N$ is less than 12.

c) The strips that have undergone a first cold rolling followed by a finishing rolling to a roughness $R_a < 0.2$ $\mu$m and brightened electrolytically show on the surface of their upper side, after creating a 1 $\mu$m thick anodic oxide layer by sulphur anodic treatment, an optical roughness value $S_N$ such that its mean variation on each section is less than 20% and $\Delta S_N$ is less than 3.5 and even 0.5.

The strips according to the invention also have a surface homogeneity such that the 2D roughness range distribution asymmetry value (Sk or skewness parameter), measured using an optical scanner-based technique described below, is between −0.2 and +0.3, and preferentially between −0.1 and +0.2. The 3D roughness ($E_k$ parameter), determined by a mechanical sensor parallel to the direction of rolling according to a method described below, is less than 15, and preferably 8.

The invention also relates to a method for making aluminium alloy strips by continuous casting between two cooled rolls, from a casting tank containing the liquid metal connected to an injector, comprising an upper lip and a lower lip, feeding the liquid metal into the gap between the two rolls, wherein the upper lip of the injector is recessed by at least 2 mm, and preferably by at least 5 mm, with reference to the lower lip.

The level of liquid metal in the casting tank, measured from the median casting level, is kept below 30 mm and preferably below 25 mm.

DETAILED DESCRIPTION OF THE INVENTION

The surface homogeneity of the upper side of the strips is assessed with two different aspects: the presence of roughness defects (mechanical scratching parallel to the longitudinal direction) and the presence of grey level oscillations (streak perpendicular to the longitudinal direction).

To characterise grey level oscillations, three different complementary techniques were used by the applicant:

The optical roughness value $S_N$ was measured using a RODENSTOCK RM 400 surface optical measurement system. This device defines and measures $S_N$ between 4 and 100, for surface roughnesses between 5 and 2000 nm. It is based on the principle of the diffusion of radiation by a rough surface. The surface to be evaluated receives an infrared beam, part of which is rediffused, the angular distribution of the diffused rays depending on the morphology of the surface.

The $S_N$ value is measured continuously on 5 cm long sections by sweeping a 0.5 mm diameter beam, and 3 longitudinal sections and 3 transverse sections taken in the same area with a diameter of approximately 10 mm are measured on each specimen. For each section, deviant isolated peaks due to accidental mechanical scratching visible to the naked eye are eliminated, distinguishing them from the ripples to characterise.

Figure 2:
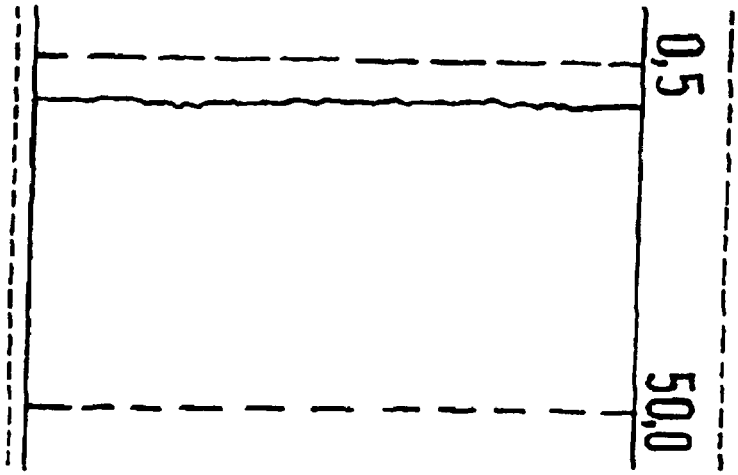
FIG. 2 represents an example of an optical roughness value $S_N$ record along a measurement section for a strip according to the invention of example 1.
Figure 3:
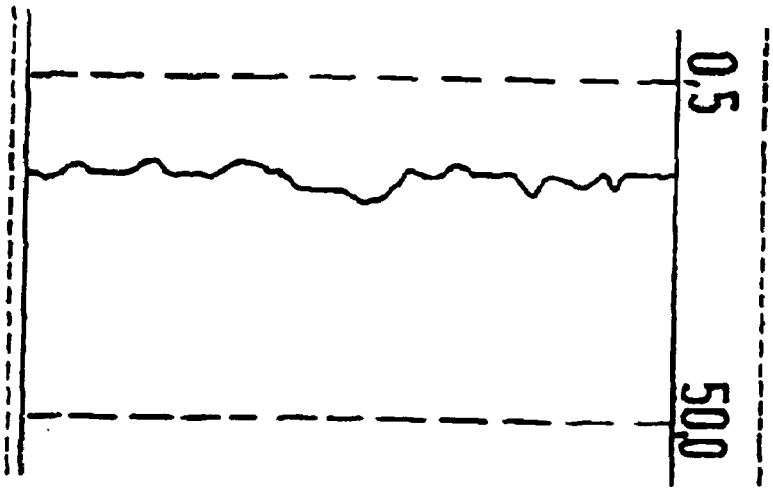
FIG. 3 represents an example of an optical roughness value $S_N$ record along a measurement section for a strip according to the prior art of example 1.

From the recorded curve, as shown in FIGS. 2 and 3, the maximum value, minimum value and mean value of $S_N$, the difference $\Delta S_N$ between the minimum value and the maximum value, and the variation of this value, defined by the ratio: $\Delta S_N / S_N$ mean, are determined. The mean of the 6 differences and variations corresponding to the 3 longitudinal and 3 transverse measurements is calculated, giving the mean difference and variation.

Another method to characterise grey level oscillations is by determining the parameter L*a*b. This measurement was made using a Minolta ChromaMeter CR-221 calorimeter, with a 3 mm diameter measurement area, a 45° lighting angle and a 0° observation angle. The lighting was supplied by a pulsating xenon bulb. The reference spectrum was IEC spectrum $D_{65}$. The parameter L*a*b was calculated according to the standard ASTM D2244-89, section 6.2. The specimens were characterised by the mean value of the parameter L*, and by the standard deviation on this parameter. For each specimen, twenty measurements along a generatrix perpendicular to the oscillations were made. This makes it possible with a unilateral risk of 0.05 to differentiate two series of measurements, for which the standard deviation ratio is 2.17. The applicant found that this test makes it possible to reproduce the visual classification of the specimens, except for specimens showing an oscillation pitch significantly lower than the measurement area diameter.

A third method to characterise grey level oscillations is the use of a scanner to obtain the mapping of the grey levels, followed by the two-dimensional roughness measurement analysis using digital methods known to those skilled in the art.

A metal plate, of a minimum size of 14 cm×14 cm, and preferably of a size similar to the DIN A4 format, to be characterised is placed on the scanner panel. A perfectly flat calibrated grey level grid used as an internal reference for each measurement is placed beside it. The tests were conducted with a reference grid marketed by Kodak; this grid comprises twenty grey levels progressing in steps of 0.10 included between a white level of density 0.00 and a practically black level of density 1.90. It proved to be necessary to block the white level of density 0.00 so as not to saturate the detection system. A UMAX type scanner was used. This device makes it possible to obtain a resolution of 150 dpi (dots per inch)×150 dpi with 256 grey levels. It was connected to a PC which recorded the digitised image in grey levels. It proved to be necessary to perform a first calibration scan with a calibration grid alone, to enable the device to select, in automatic mode, the suitable contrast. Then, the digitisation is performed with a specimen and the reference grid. Provided that the calibrated reference grid is always used, those skilled in the art can use other scanner models with at least comparable performances.

Using a software application (in this case, Spyglass Transform 3.02©), the area under study was selected interactively; the reference grid and the edges of the remaining image, typically 1 to 3 cm on each edge, and, if necessary, peripheral areas showing fog or spots not representative of the grey level oscillations to be characterised, were removed. The working area obtained must have a minimum size of 12 cm×12 cm.

The two-dimensional roughness profile is then analysed on seven lines parallel to the direction of rolling (i.e. perpendicular to the grey level oscillation) at least 100 mm long, selected at random in the working area. If the base line of this profile shows a deviation (particularly due to a scanner lighting defect), it is then necessary to rectify it in such a way so as not to affect the roughness itself. This correction may be carried out using the box method, known by specialists, the box size being adjusted so as to reproduce the pitch and range of the profile in an optimal fashion.

The four roughness parameters, known by the specialist, the mean absolute deviation Ra, the mean square deviation Rq, the maximum roughness Rt, and the skewness Sk defined as $$S_k = \frac{1}{R_q^3} \times \frac{1}{n} \sum_{i=1}^{i=n} (y_1 - \bar{y})^3$$

where $$R_q = \sqrt{\frac{1}{1_m} \int_0^x y^2 \, dx}$$

and where $\mathbf{1}_m$ corresponds to the mean line, given that for an ideal Gaussian distribution, Sk=0, are then calculated.

The applicant observed that for specimens with homogeneous surfaces, the Sk value is between −0.2 and +0.3. To be able, for example, to produce optical reflectors, an Sk value between −0.1 and +0.2 is preferred. Specimens with non-homogeneous surfaces, corresponding to the prior art, have an Sk value below −0.4. For example, the applicant found values between −0.45 and −1.38 for specimens of 8011 alloy obtained using the twin-roll casting process according to the prior art.

To characterise roughness defects, a three-dimensional mechanical roughness measurement method was used. The specimen is placed on a TIXV 200 crossed table. The sensor (Mahr Mesures model FRW 750), with a 5 μm radius of curvature, was conditioned by a Mahr Mesures Perthometer PRK device. The data was recorded using an analogue-digital conversion card in a PC. The size of the measurement field was 20 mm×20 mm, with a pitch of 40 μm along x and y. The theoretical depth resolution was given by the maximum range of the sensor (100 μm) and the characteristics of the microprocessor (16 bits), or approximately 0.024 μm.

The three-dimensional roughness was calculated with a software application supplied by Saphir according to the following equations:

$$R_a = \frac{1}{NM} \sum_i^N \sum_j^M |Z_{ij} - Z_0|$$

where N is the number of points along x, M the number of points along y, Z0 the mean altitude on the observation surface according to $$Z_0 = \frac{1}{NM} \sum_i^N \sum_j^M Z_{ij};$$

$$R_q = \sqrt{\frac{1}{NM} \sum_i^N \sum_j^M |Z_{ij} - Z_0|^2};$$

$$S_k = \frac{1}{NMR_q^3} \sum_i^N \sum_j^M |Z_{ij} - Z_0|^3;$$

$$E_k = \frac{1}{NMR_q^4} \sum_i^N \sum_j^M |Z_{ij} - Z_0|^4;$$

The parameter Ek, or kurtosis, characterises the flatness of the distribution; it takes the value 3 for an ideal Gaussian distribution.

All the measurements may be made on the upper side, i.e. the side that was in contact with the upper roll, outside areas showing accidental defects such as scratching due to handling or spots, for as cast strips, strips simply cold-rolled or cold-rolled strips then subjected to finishing passes with polished rolls. To be representative of the target application, the measurements are all made on specimens subjected to a sulphur anodic treatment under the following conditions: sulphuric acid concentration 200 g/l, temperature 20° C., voltage 15 V. This treatment results in a 1 μm thick oxide layer. It may be preceded by preliminary alkaline pickling (e.g. at a temperature of 60° C. for 7 minutes in a bath containing 50 g/l ALUMINUX 138, a commercially available soda-based product).

For strips produced by twin-roll casting according to the prior art, the mean variation of $S_N$ is greater than 50%, both for as cast strips and for cold-rolled strips. For the strips according to the invention, the mean variation is less than 20% in any case. The difference $\Delta S_N$ is less than 20 for untreated casting strips, and less than 12 for cold-rolled strips to a thickness between 4 and 0.1 mm, having undergone alkaline pickling before the anodic treatment. It is less than 3.5, and even frequently less than 0.5 for strips after the final "polished" cold rolling, i.e. resulting in a roughness $R_a$ less than 0.2 μm, and then brightened electrolytically before the 1 μm anodic treatment layer.

Figure 1:
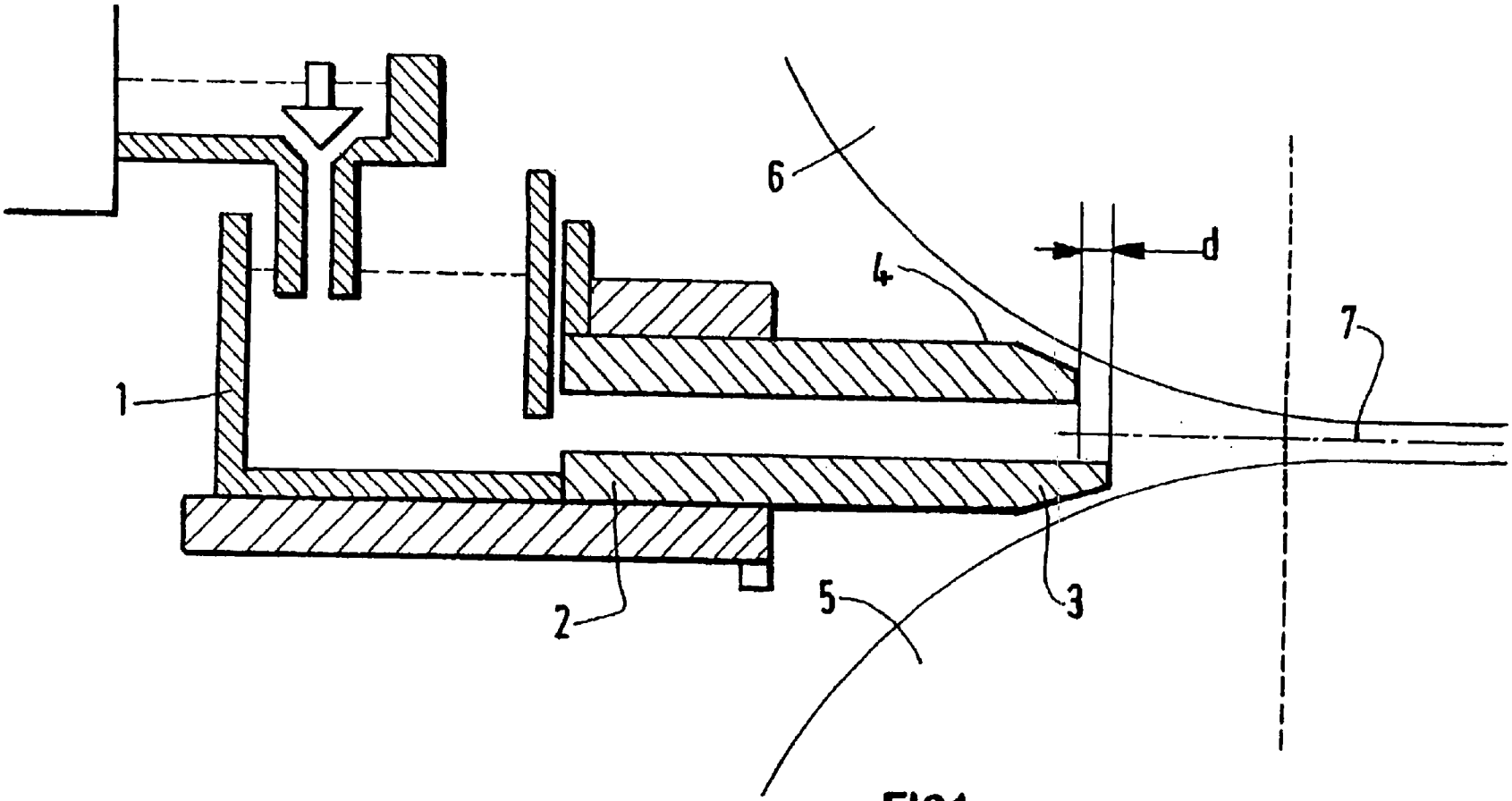
FIG. 1 represents a cross section perpendicular to the roll axis of a twin-roll casting machine, according to the invention.

Surprisingly, it was observed than the surface homogeneity of the upper side of twin-roll casting cast strips is improved markedly by a slight modification of the casting machine represented schematically in FIG. 1.

The machine comprises a casting tank 1 supplied with liquid aluminium alloy and connected to an injector 2, composed of a lower lip 3 and an upper lip 4, feeding the liquid metal in the gap between the two rolls 5 and 6 rotating in opposite directions. The strip 7 comes out of the other side of the gap between the rolls solidified. The modification according to the invention consists of using an injector comprising an upper lip 4 recessed by a distance d with reference to the lower lip 3. This recess d is at least 2 mm and, preferably, at least 5 mm. To prevent this arrangement from inducing an excessive influx of liquid metal in the gap between the two rolls, it is advisable to reduce the metallostatic pressure, i.e. the level of the metal, in the casting tank 1, measured from the median casting level, to less than 30 mm and preferably less than 25 mm, particularly the greater the recess d. The recess of the upper lip of the injector also makes it possible to obtain a more precise positioning of the injector, preventing accidental friction on the roll surface, and thus indirectly improving the surface condition of the lower side of the cast strip. With a level of metal below 25 mm and an injector upper lip recess of at least 25 mm, the applicant successfully produced polished 1000 and 8000 series alloy products finished by rolling with polished rolls (skin pass rolling) which had identical properties for use as the known products, produced using the more costly semi-continuous casting and hot rolling process. These products could be used to produce flat, folded or drawn light reflectors.

The invention is applicable to all aluminium alloys liable to be cast by twin-roll casting. For example, the applicant obtained good results with some 3000 series alloys and some low-magnesium Al—Mg type alloys such as 5005.

The invention is of particular interest for 1000 and 8000 series AlFeSi alloys, containing 0.01 to 2% by weight of iron and 0.1 to 2% of silicon. Indeed, these alloys, when they are cast by twin-roll casting, show markedly higher mechanical characteristics than those obtained with conventional casting and hot rolling, making their "polished" rolling easier. One of the reasons for the higher mechanical resistance of the strips obtained by continuous casting for this type of alloy is that the quantity of iron in the solid solution in the aluminium is higher. For an alloy containing more than 0.01% (100 ppm) of iron, the quantity of iron in solid solution is greater than 50 ppm+0.03×(Fe content in ppm). Another advantage of having a high iron level in solid solution is, for a given iron content, to reduce the intermetallic iron compounds, the presence of which on the surface is a source of optical defects. For the same reasons, the invention is also of particular interest for low Mg alloys (Mg<1.5%).

In addition, a surface grain size, defined as the mean width of the grains on the surface, measured perpendicular to the direction of rolling by image analysis, less than 20 $\mu$m, and frequently 15 $\mu$m, is obtained, both on as cast strips and on cold-rolled strips, reducing some appearance defects such as lines. This characteristic of the strips according to the invention is also favourable for subsequent shaping, e.g. by drawing.

EXAMPLE 1

An EN AW-1085 alloy (according to the standard NF EN 573-3) was prepared with the following composition (% by weight): Si=0.040 Fe=0.038 Cu=0.0017 Mn=0.0022 Mg=0.0032 Zn=0.002 Ti=0.02 with an addition of 3 kg/t of titanium/boron refining agent. The metal was treated with argon in a Pechiney Rhenalu Alpur® foundry ladle, and then cast continuously on a Pechiney Rhenalu JUMBO CM® twin-roll casting machine.

The roll diameter was 1150 mm, with a gap between the two rolls of 2.3 mm. The Styrite® ceramic injector comprised an upper lip recessed by 7 mm with reference to the lower lip, and was supplied by a casting tank with a level of liquid metal of approximately 18 mm. The casting was carried out at a width of 1370 mm, a cast strip thickness of 3.6 mm, a casting rate of 1.6 m/min and a force between the rolls of 800 t/m of strip width. The strip was then cold-rolled to a thickness of 0.4 mm.

Strips with the same composition were also prepared using the standard method consisting of vertical semi-continuous casting, hot rolling of the plates followed by cold rolling to the same thickness of 0.4 mm at two different work hardening rates.

The mechanical characteristics of the strips were compared, i.e. the rupture strength $R_m$ (in MPa), the elasticity limit $R_{0.2}$ (in MPa), the stretch (in %) and the work hardening rate n (in %). The results are given in table 1 and show that for this 1085 alloy, according to the invention, values of Rm>165 MPa, $R_{0.2}$>160 MPa and A>6% are obtained.

TABLE 1

| Source | $R_m$ (MPa) | $M_{0.2}$ (MPa) | A (%) | n (%) |
|---|---|---|---|---|
| JUMBO 3CM continuous casting | 173 | 167 | 7.7 | 80 |
| semi-continuous casting | 155 | 148 | 7 | 93 |
| semi-continuous casting | 165 | 158 | 6.2 | 96 |

It is noted that continuous casting results in both a higher mechanical resistance with a lower work hardening rate, thus making polished rolling easier, and an improved stretch enabling easier shaping.

It was also noted that the surface grain size, determined by image analysis, was 7 $\mu$m for strips according to the invention and 80 $\mu$m for strips obtained from vertical semi-continuous casting.

Strips with the same composition were also prepared again with Pechiney Rhenalu JUMBO CM® twin-roll casting but with an injector according to the prior art with no recess of the upper lip. These strips followed the same process as the strips according to the invention to a thickness of 0.4 mm.

The strips according to the invention and the strips obtained by twin-roll casting with an injector according to the prior art then underwent two finishing passes with polished rolls from 0.4 mm to 0.35 mm. After electrolytic brightening followed by anodic treatment with sulphuric acid resulting in a 1 $\mu$m thick layer, the optical properties of the strips were measured using the RODENSTOCK RM 400 system. The results are given in table 2.

TABLE 2

| | $S_N$ max | $S_N$ min | $S_N$ max − $S_N$ min | $S_N$ max − $S_N$ min/ $S_N$ mean |
|---|---|---|---|---|
| Strips according to the invention | 7.4 | 6.4 | 1 | 14% |
| Strips according to the prior art | 11 | 7 | 4 | 50% |

Records of the roughness value on the strips are given in FIGS. 2 and 3.

EXAMPLE 2

An EN AW-1070A alloy (according to the standard NF EN 573-3) was prepared: Si=0.06 Fe=0.12 Ti=0.015 with an addition of 1.5 kg/t of titanium/boron refining agent. The metal was cast continuously on the same Pechiney Rhenalu JUMBO 3 CM® twin-roll casting machine as for example 1.

The injector also made of Styrite® ceramic injector comprised an upper lip recessed by 10 mm with reference to the lower lip, and was supplied by a casting tank with a level of liquid metal of approximately 18 mm. The strip width was 1370 mm, the cast strip thickness 3 mm, the casting rate 2 m/min and a force between the rolls 900 t per meter of strip width.

The strips cast in this way were then cold-rolled to a thickness of 0.8 mm and underwent two rolling passes with polished rolls to 0.5 mm. Strip specimens were sampled as the process progressed, first 3 mm as cast strips, then 0.8 mm strips after cold rolling and, finally, 0.5 mm after "polished" rolling.

The 3 mm as cast specimens received a 1 μm thick sulphur anodic treatment. The 0.8 mm strip specimens after cold rolling underwent alkaline pickling on 10 μm followed by a 1 μm thick sulphur anodic treatment. The 0.5 mm strip specimens after polished rolling successively underwent electrolytic brightening and a 1 μm thick sulphur anodic treatment.

Strips with the same composition were also prepared again with Pechiney Rhenalu JUMBO 3 CM® twin-roll casting but with an injector according to the prior art with no recess of the upper lip. These strips followed the same process as the strips according to the invention up to 0.5 mm and, like said strips, underwent electrolytic brightening and a 1 μm thick sulphur anodic treatment.

The optical properties of all the specimens were measured using the RODENSTOCK RM 400 system. The results are given in table 3.

TABLE 3

| | Thickness in mm | $S_N$ max | $S_N$ min | $S_N$ max − $S_N$ min | $S_N$ max − $S_N$ min/ $S_N$ mean |
|---|---|---|---|---|---|
| Anodised as cast strips, according to the invention | 3 | 53 | 44 | 9 | 19% |
| Anodised pickled rolled strips, according to the invention | 0.8 | 36 | 32 | 4 | 11% |
| Anodised "polished" rolled strips, according to the invention | 0.5 | 10 | 8.5 | 1.5 | 17% |
| Anodised "polished" rolled strips, according to the prior art | 0.5 | 19 | 13 | 6 | 37% |

In addition, a surface grain size of 12 μm was measured on the strips according to the invention while the strips with the same composition, subjected to the same cold rolling procedures but obtained using the conventional process (vertical semi-continuous rolling followed by hot rolling of plates) have surface grain sizes of the order of 70 μm.

EXAMPLE 3

For each twin-roll casting, seven different castings were carried out with the following characteristics:

TABLE 4

| reference | Alloy | Fe and Si content | casting rate | casting thickness |
|---|---|---|---|---|
| R1 | 8011 | Fe 0.60; Si 0.75 | 0.96 m/min | 7.0 mm |
| R3 | 1050 | Fe 0.20; Si 0.14 | | 3.0 mm |
| R4 | 1235 | Fe 0.37; Si 0.14 | 2.5 m/min | 2.7 mm |
| R5 | 1085 | | see example 1 | |

TABLE 4-continued

| reference | Alloy | Fe and Si content | casting rate | casting thickness |
|---|---|---|---|---|
| R6 | 8011 | Fe 0.70; Si 0.73 | 1.6 m/min | 3.1 mm |
| R7 | 1085 | | see example 1 | |

The casting R5 corresponds to that in example 1, carried out with the twin-roll casting process according to the invention.

The casting R7 corresponds to that in example 1, carried out according to the prior art with a conventional injector.

The other castings were carried out with a twin-roll casting machine similar to that described in example 1.

The results of the optical and roughness measurement characterisations, after pickling and anodic treatment of the untreated casting strips, were as follows:

TABLE 5

| Grey level oscillation characterisation | | | |
|---|---|---|---|
| | Measurement L*a*b | | |
| Reference | L* mean | Standard deviation on L* mean | visual classification (1: best 7: poorest) |
| R1 | 74.74 | 0.26 | 7 |
| R2 | 75.47 | 0.31 | 3 |
| R3 | 77.98 | 0.45 | 4 |
| R4 | 79.42 | 0.20 | 2 |
| R5 | 82.50 | 0.23 | 1 |
| R6 | 74.54 | 0.46 | 5 |
| R7 | 74.99 | 0.77 | 6 |

TABLE 6

| 3D roughness measurement roughness defect characterisation | | | | |
|---|---|---|---|---|
| ref. | Ra μm | Rq μm | Sk | Ek |
| R1 | 2.622 | 4.401 | −4.124 | 35.830 |
| R3 | 2.111 | 2.745 | −0.784 | 4.640 |
| R4 | 3.158 | 4.060 | −0.643 | 4.364 |
| R5 | 2.905 | 3.661 | −0.614 | 3.542 |
| R6 | 1.759 | 2.316 | −0.856 | 6.168 |
| R7 | 2.681 | 4.033 | −2.678 | 27.002 |

It is noted that the standard deviation of the parameter L*mean corresponds to the visual response, except for specimen R1 for which the grey level oscillation pitch is too low with reference to the diameter of the area of an individual measurement. On an industrial level, the specimens R1 and R7 cannot be used for the target applications, since their surface condition is unacceptable in aesthetic and optical terms.

The applicant noted that for the 3D roughness measurement, only the Sk and Ek parameters make it possible to discriminate between the products according to the invention and the products unsuitable for demanding applications in terms of surface appearance.

The applicant also noted that to obtain a surface enabling the target applications, one, or preferentially all, of the following conditions must be met:

the 3D roughness measurement value of sk according to the procedure described must be greater than −2.0 and preferentially greater than −1.0;

the 3D roughness measurement value of Ek must be less than 15 and preferentially less than 8.

The applicant observed that it is preferable, in addition to the one or two conditions mentioned above, for the surface to also have a standard deviation on the value L*mean less than 0.5 and preferentially less than 0.3.

What is claimed is:

1. Aluminum alloy strip with high surface homogeneity produced by twin-roll casting, said strip comprising an upper side having, after a 1 $\mu$m thick sulphur anodic treatment, an optical roughness value $S_N$ measured on three 5 cm longitudinal sections and three 5 cm transverse sections, such that there is mean variation on each section, defined by the ratio:

$$(\text{Maximum } S_N - \text{minimum } S_N)/\text{Mean } S_N$$

which is less than 20%, and a difference $\Delta S_N = S_N \max - S_N \min$ which is less than 20.

2. Aluminum alloy strip with high surface homogeneity produced by twin-roll casting and then cold-rolled to a thickness between 4 and 0.1 mm, said strip comprising an upper side having, after an acid pickling treatment on a 10 $\mu$m thickness, followed by a 1 $\mu$m thick sulphur anodic treatment, an optical roughness value $S_N$ measured on three 5 cm longitudinal sections and three 5 cm transverse sections, such that there is a variation of less than 20% and a difference $\Delta S_N$ of less than 12.

3. Aluminum alloy strip with high surface homogeneity produced by twin-roll casting, said strip comprising an upper side having, after pickling and sulphur anodic treatment, at least one characteristic selected from the group consisting of:

an Sk value determined by 3D roughness measurement greater than −2.0; and (b) an Ek value determined by 3D roughness measurement less than 15.

4. Strip according to claim 3, wherein a value L* determined according to ASTM D2244-89, section 6.2, calculated on the basis of 20 individual measurements along a generatrix parallel to a longitudinal direction has a standard deviation which is less than 0.5.

5. Aluminum alloy strip with high surface homogeneity produced by twin-roll casting, comprising an upper side having, after pickling and sulphur anodic treatment, an Sk value, obtained by 2D roughness measurement analysis of images obtained with an optical scanner, between −0.2 and +0.3.

6. Aluminum alloy strip with high surface homogeneity produced by twin-roll casting and then cold-rolled to a thickness between 4 and 0.1 mm, having undergone at least one finishing pass with polished cylinders, with a roughness Ra<0.2 um, said strip comprising an upper side, after electrolytic brightening followed by a 1 $\mu$m thick sulphur anodic treatment, having an optical roughness value $S_N$ measured on three 5 cm longitudinal sections and three 5 cm transverse sections, with a variation which is less than 20%, and the difference $\Delta S_N$ which is less than 3.5.

7. Strip according to claim 1, having, on the upper side, a grain size, measured by image analysis, less than 20 $\mu$m.

8. Strip according to claim 1, wherein the aluminum alloy is a 1000 series or 8000 series alloy containing between 0.01 and 2% by weight of iron and between 0.01 and 2% by weight of silicon, and iron present in solid solution is greater than 50 ppm+0.03×ppm total Fe.

9. Strip according to claim 1, wherein the aluminum alloy is a 5000 series alloy containing less than 1.5% of Mg.

10. Strip according to claim 2, wherein the thickness is between 2 and 0.1 mm.

11. Strip according to claim 3, wherein Sk is greater than −1.0.

12. Strip according to claim 3, wherein Ek is less than 8.

13. Strip according to claim 4, wherein the standard deviation is less than 0.3.

14. Strip according to claim 5, wherein the Sk value is between −0.1 and +0.2.

15. Strip according to claim 6, wherein the thickness is between 2 and 0.1 mm.

16. Strip according to claim 7, wherein the grain size is less than 15 $\mu$m.

17. An optical reflector comprising an aluminum alloy strip according to claim 1.

18. An optical reflector comprising an aluminum alloy strip according to claim 2.

19. An optical reflector comprising an aluminum alloy strip according to claim 3.

20. An optical reflector comprising an aluminum alloy strip according to claim 5.

21. An optical reflector comprising an aluminum alloy strip according to claim 6.

22. An anodized and optionally lacquered construction plate comprising an aluminum alloy strip according to claim 1.

23. An anodized and optionally lacquered construction plate comprising an aluminum alloy strip according to claim 2.

24. An anodized and optionally lacquered construction plate comprising an aluminum alloy strip according to claim 3.

25. An anodized and optionally lacquered construction plate comprising an aluminum alloy strip according to claim 5.

26. An anodized and optionally lacquered construction plate comprising an aluminum alloy strip according to claim 6.

27. A drawn part comprising an aluminum alloy strip according to claim 1.

28. A drawn part comprising an aluminum alloy strip according to claim 2.

29. A drawn part comprising an aluminum alloy strip according to claim 3.

30. A drawn part comprising an aluminum alloy strip according to claim 5.

31. A drawn part comprising an aluminum alloy strip according to claim 6.

* * * * *